US010717275B2

(12) United States Patent
Yamamoto et al.

(10) Patent No.: US 10,717,275 B2
(45) Date of Patent: Jul. 21, 2020

(54) DRYING APPARATUS, AND AN INKJET PRINTING APPARATUS HAVING THE SAME

(71) Applicant: SCREEN HOLDINGS CO., LTD., Kyoto (JP)

(72) Inventors: Takaharu Yamamoto, Kyoto (JP); Yuto Suzuki, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/356,637

(22) Filed: Mar. 18, 2019

(65) Prior Publication Data

US 2019/0291428 A1 Sep. 26, 2019

(30) Foreign Application Priority Data

Mar. 22, 2018 (JP) ..... 2018-054428

(51) Int. Cl.

| | |
|---|---|
| ***B41J 2/14*** | (2006.01) |
| ***B41J 15/04*** | (2006.01) |
| ***B41F 23/04*** | (2006.01) |
| ***B41J 11/00*** | (2006.01) |

(52) U.S. Cl.

CPC ..... *B41J 2/14088* (2013.01); *B41F 23/0426* (2013.01); *B41J 11/002* (2013.01); *B41J 15/04* (2013.01)

(58) Field of Classification Search

CPC ..... B41J 2/14088; B41J 11/002; B41J 15/04; B41F 23/0426

USPC ..... 347/102

See application file for complete search history.

(56) References Cited

U.S. PATENT DOCUMENTS

| | | | | |
|---|---|---|---|---|
| 2010/0188469 | A1 | 7/2010 | Ikegami | |
| 2015/0174924 | A1* | 6/2015 | Fuchioka | B41J 11/002 347/102 |
| 2017/0173973 | A1 | 6/2017 | Tsutsui et al. | |

FOREIGN PATENT DOCUMENTS

| | | | |
|---|---|---|---|
| JP | 2013-203544 | A | 10/2013 |

OTHER PUBLICATIONS

Extended European Search Report issued in corresponding European Patent Application No. 19163405.4-1008, dated Jul. 23, 2019.

* cited by examiner

*Primary Examiner* — Huan H Tran
*Assistant Examiner* — Alexander D Shenderov
(74) *Attorney, Agent, or Firm* — McDermott Will & Emery LLP

(57) ABSTRACT

A drying apparatus for drying a printing medium having ink droplets dispensed thereto includes a rotatable drive roller, and a warm air blasting unit. The warm air blasting unit includes a pair of warm air blasting portions, and one air intake duct. Each warm air blasting portion has a nozzle case, a fan duct, and a blasting fan. The one air intake duct has a suction fan for feeding ambient air into the air intake duct.

16 Claims, 10 Drawing Sheets

DRYING APPARATUS, AND AN INKJET PRINTING APPARATUS HAVING THE SAME

BACKGROUND OF THE INVENTION

(1) Field of the Invention

This invention relates to a drying apparatus for drying a printing medium having ink droplets dispensed thereto by blowing warm air to the printing medium, and an inkjet printing apparatus having such a drying apparatus.

(2) Description of the Related Art

Conventionally, this type of drying apparatus has a heat drum for heating web paper carrying ink droplets dispensed thereto, the web paper being wound on the heat drum to have a surface without the ink droplets in contact with the heat drum, and a plurality of warm air blasting units arranged opposite the heat drum across a transport route of the web paper for blowing warm air toward the transport route (see Japanese Unexamined Patent Publication No. 2013-203544 (FIG. 3), for example).

Each warm air blower unit has warm air blasting portions each including a nozzle case containing a heater with a long axis thereof extending transversely of the web paper and having a blasting port formed for blowing warm air toward the transport route, a fan duct attached to the nozzle case for sending air into the nozzle case, a blasting fan attached to a near side of the fan duct, an air intake duct attached to the nozzle case for collecting part of the warm air blown off from the blasting port, and a suction fan located at a deep side of the air intake duct for feeding ambient air into the air intake duct. The air intake duct has a near side thereof connected to a blasting fan side of the fan duct. Each warm air blasting unit is constructed by a combination of two warm air blasting portions to have the air intake ducts in between.

In the warm air blasting unit constructed in this way, the quantity of airflow of the blasting fan is larger than that of the suction fan which takes in ambient air. Consequently, part of the warm air blown from the blasting port to the web paper is collected by the air intake duct, thereby to improve thermal efficiency.

However, the conventional example with such construction has the following problem.

Since, in the conventional apparatus, two air intake ducts are located between two warm air blasting portions, each air intake duct has a small passage sectional area. Consequently, compared with a side near the suction fan, a side far from the suction fan has a weak air intake, thus causing an uneven intake of the warm air in the transverse direction of the web paper. This makes a large temperature gradient, and an uneven temperature distribution, in the transverse direction of the web paper on the transport route to which the warm air is blown from the blasting port of the nozzle case. As a result, there occurs a problem of a difference in the degree of dryness in the transverse direction of the web paper.

It is unrealizable to dry the web paper on the transport route uniformly in the transverse direction only by blowing warm air to provide an even temperature distribution in the transverse direction. This is because, although the ink droplets are dried by blowing warm air, the drying rate will be affected unless the warm air containing the liquid components of the ink droplets is collected as uniformly as possible in the transverse direction.

SUMMARY OF THE INVENTION

This invention has been made having regard to the state of the art noted above, and its object is to provide a drying apparatus which can make the degree of dryness substantially uniform in a transverse direction of web paper, and an inkjet printing apparatus having such a drying apparatus.

To fulfill the above object, this invention provides the following construction.

A drying apparatus for drying a printing medium having ink droplets dispensed thereto, according to this invention, comprises a drive roller rotatable in contact with an opposite surface of a printed surface, to which the ink droplets have been dispensed, of the printing medium, while transporting the printing medium along a transport route; and a warm air blasting unit located opposite the drive roller across the transport route for blowing warm air toward a full width of the printing medium on the transport route; wherein the warm air blasting unit includes a pair of warm air blasting portions, each having a nozzle case for heating air, the nozzle case forming a blasting port for blowing off warm air toward the transport route, a fan duct attached to the nozzle case for feeding air into the nozzle case, and a blasting fan attached to one end of the fan duct; one air intake duct located between the pair of warm air blasting portions in a transport direction of the printing medium and connected to one end of each of the fan ducts of the pair of warm air blasting portions for collecting part of the warm air blown off from the blasting ports of the pair of warm air blasting portions; and a suction fan disposed at the other end of the one air intake duct which corresponds to the other ends of the fan ducts for feeding ambient air into the one air intake duct.

According to this invention, the warm air blasting unit includes one air intake duct disposed between a pair of warm air blasting portions and connected to one end of the fan duct of each warm air blasting portion. Consequently, since the one air intake duct recovers warm air, the passage sectional area can be made larger than in the prior art. As a result, the intake of warm air in the transverse direction of the printing medium can be made uniform. This can substantially uniform a temperature distribution on the transport route to which warm air is blown from the blasting ports of the nozzle cases. Consequently, the degree of dryness in the transverse direction of the printing medium can be made substantially uniform.

In this invention, it is preferred that each nozzle case and the air intake duct have an air layer located in between.

Air heat insulation is provided for each nozzle case and air intake duct by locating the air layer between the nozzle case and air intake duct. Consequently, the nozzle cases are not subject to influences of air colder than the warm air in the nozzle cases, the cold air being fed in by the suction fan from the other end of the air intake duct, thereby preventing a temperature drop in portions adjacent the suction fan of the nozzle cases. As a result, the temperature distribution in the transverse direction of the printing medium of the warm air blown off from the blasting ports of the nozzle cases can be made further uniform.

In this invention, it is preferred that the one air intake duct has warm air intake ports arranged adjacent the transport route from adjacent the suction fan to adjacent the blasting port; and a plurality of air intake hoods arranged linearly along the warm air intake ports, with openings that open away from the suction fan; and that the openings of the air intake hoods are formed such that, when a ratio of a sectional area of each opening to a passage sectional area of the one air intake duct is a hood area percentage, the hood area percentage becomes smaller away from the suction fan along a logarithmic function.

A plurality of air intake hoods are arranged adjacent the warm air intake ports of the suction fan, and the hoods have openings formed to have hood area percentage becoming smaller away from the suction fan along a logarithmic function. Consequently, flow path resistance, which is large adjacent the near the suction fan, becomes logarithmically smaller away from the suction fan. As a result, even when the quantity of airflow of the suction fan is adjusted, the air intake in the transverse direction perpendicular to the transport direction of the printing medium can be inhibited from being put out of balance, and variations in temperature distribution can be minimized. Thus, even if the quantity of warm air blown off from the blasting ports is changed according to characteristics of the printing medium, the degree of dryness in the transverse direction can be maintained constant.

In this invention, it is preferred that the blasting ports of the warm air blasting unit are in positions directed downward to provide such vertical sectional shapes seen from a transverse direction perpendicular to the transport direction of the printing medium as an inverted triangular shape for the nozzle cases and a triangular shape for the one air intake duct.

Since an inverted triangular shape and a triangular shape are combined in the transport direction, the size in the transport direction of the warm air blasting unit can be made small. Consequently, the warm air blasting unit can be reduced in size.

In this invention, it is preferred that each nozzle case has side plates arranged at opposite ends of the blasting port in a transverse direction perpendicular to the transport direction of the printing medium, the side plates having spill holes for letting out part of the warm air to be blown off from the nozzle case.

Since, generally, flow speed lowers due to friction with the side plates adjacent the opposite ends relative to the opening length of the blasting port in the transverse direction, a length that provides a uniform flow speed is shorter than the opening length. So, by discharging part of the warm air from the spill holes in the side plates at the opposite ends of the blasting port, the friction causing pressure loss in the opposite end regions of the blasting port can be reduced. Consequently, the warm air having a nearly uniform flow speed can be blown off over the full width of the blasting port. The length that provides a uniform flow speed can be increased, thereby to inhibit the nozzle case from enlarging in the transverse direction. As a result, the nozzle case can be reduced in size, thereby to attain a reduction in size of the warm air blasting unit.

In another aspect of this invention, a printing apparatus for printing on a printing medium, comprises a printing unit for performing printing by dispensing ink droplets to the printing medium; and a drying device disposed downstream of the printing unit; wherein the drying device includes a drive roller rotatable in contact with an opposite surface of a printed surface, to which the ink droplets have been dispensed, of the printing medium, while transporting the printing medium along a transport route; and a warm air blasting unit located opposite the drive roller across the transport route for blowing warm air toward a full width of the printing medium on the transport route; the warm air blasting unit including a pair of warm air blasting portions, each having a nozzle case for heating air, the nozzle case forming a blasting port for blowing off warm air toward the transport route, a fan duct attached to the nozzle case for feeding air into the nozzle case, and a blasting fan attached to one end of the fan duct; one air intake duct located between the pair of warm air blasting portions in a transport direction of the printing medium and connected to one end of each of the fan ducts of the pair of warm air blasting portions for collecting part of the warm air blown off from the blasting ports of the pair of warm air blasting portions; and a suction fan disposed at the other end of the one air intake duct which corresponds to the other ends of the fan ducts for feeding ambient air into the one air intake duct.

According to this invention, the warm air blasting unit includes one air intake duct disposed between a pair of warm air blasting portions and connected to one end of the fan duct of each warm air blasting portion. Consequently, since the one air intake duct recovers warm air, the passage sectional area can be made larger than in the prior art. As a result, the intake of warm air in the transverse direction of the printing medium can be made substantially uniform. This can substantially uniform a temperature distribution on the transport route to which warm air is blown from the blasting ports of the nozzle cases. Consequently, the degree of dryness in the transverse direction of the printing medium can be made substantially uniform, thereby improving the quality of printing by the printing unit.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

FIGS. 3A-3B are orthogonal views showing outward appearances of a warm air blasting unit, in which FIG. 3A is a front view, FIG. 3B is a plan view.

FIGS. 11A and 11B are schematic views illustrating the effect of spill ports, in which FIG. 11A shows a conventional technique, and FIG. 11B shows the embodiment.

DESCRIPTION OF THE PREFERRED EMBODIMENTS

An embodiment of this invention will be described hereinafter with reference to the drawings.

Figure 1:
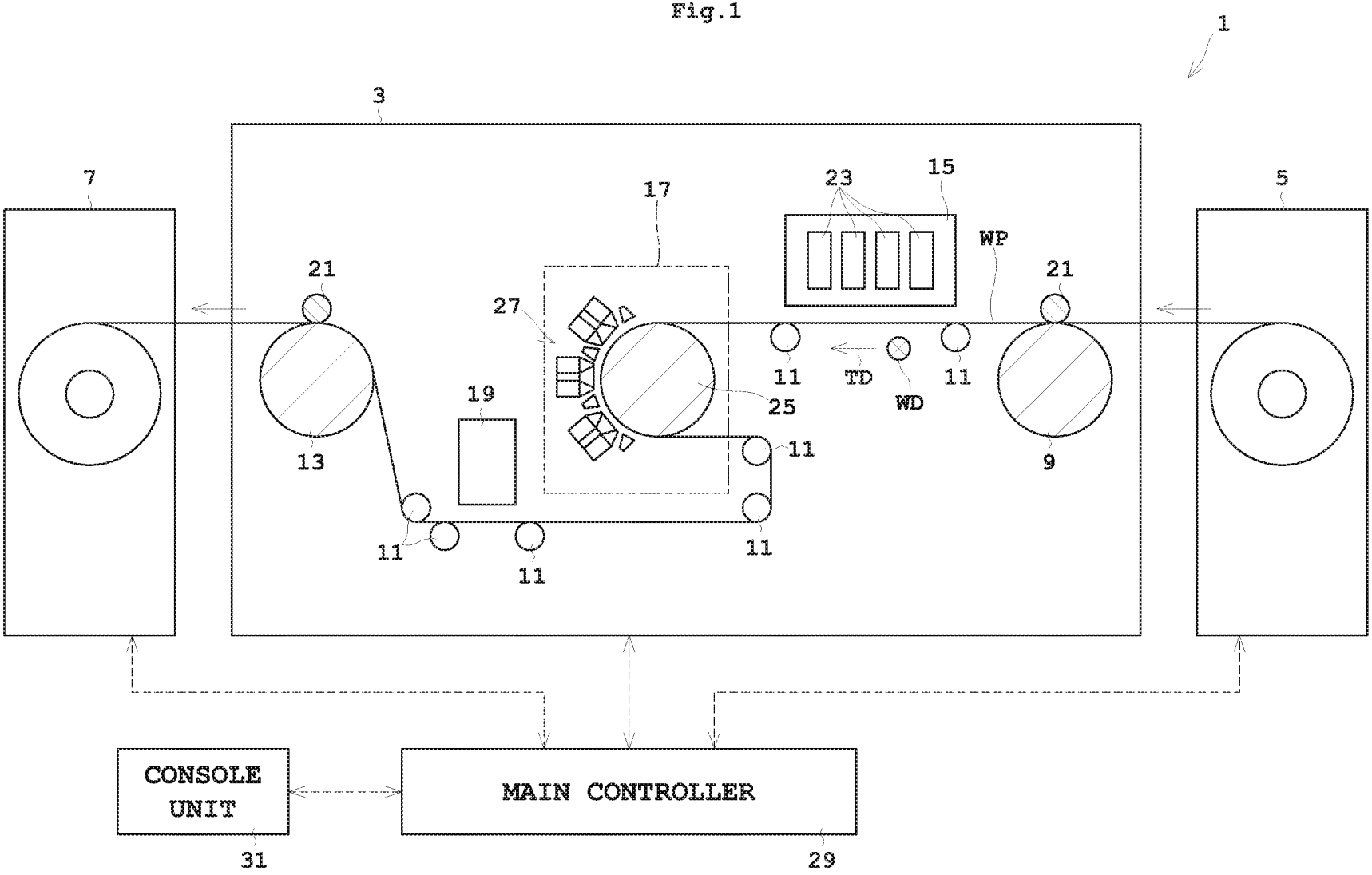
FIG. 1 is an outline schematic view showing an entire construction of an ink jet printing system according to an embodiment.

FIG. 1 is an outline schematic view showing an entire construction of an ink jet printing system according to the embodiment.

An ink jet printing system 1 includes an inkjet printing apparatus 3, a paper feeder 5, and a takeup roller 7. The inkjet printing apparatus 3 prints on sheetlike web paper WP. The paper feeder 5 holds a roll of web paper WP to be rotatable about a horizontal axis, and unwinds the web paper WP from the roll of web paper WP to feed it to the inkjet printing apparatus 3. The takeup roller 7 winds up the web paper WP printed in the inkjet printing apparatus 3 into a roll form around a horizontal axis. Regarding the supply side of web paper WP as upstream and the delivery side of web paper WP as downstream, the paper feeder 5 is located upstream of the inkjet printing apparatus 3, and the takeup roller 7 downstream of the inkjet printing apparatus 3.

The above web paper WP corresponds to the "printing medium" in this invention, and the inkjet printing apparatus to the "printing apparatus" in this invention.

The inkjet printing apparatus 3 has a drive roller 9 located in an upstream position for taking in the web paper WP from the paper feeder 5. The web paper WP unwound from the paper feeder 5 by the drive roller 9 is transported along driven, rotatable transport rollers 11 and other components downstream toward the takeup roller 7. A drive roller 13 is located between an inspection unit 19 described hereinafter and the takeup roller 7. This drive roller 13 feeds the web paper WP having passed through the inspection unit 19 toward the takeup roller 7.

The inkjet printing apparatus 3 has, between the drive roller 9 and drive roller 13, a printing unit 15, a drying station 17, and the inspection unit 19 arranged in the stated order from upstream. Nip rollers 21 are rotatably provided for the drive rollers 9 and 13, respectively. The nip rollers 21 give gripping forces at the time of transporting the web paper WP by pressing on the drive rollers 9 and 13 from opposite sides of the drive rollers 9 and 13 across the web paper WP. Their pressing forces are applied by air cylinders, for example. The nip rollers 21 are constructed of an elastic body such as rubber, for example.

The printing unit 15 has a plurality of inkjet heads 23 for dispensing ink droplets. The printing unit 15 has the inkjet heads 23 arranged in a transverse direction WD (in a depth direction on the plane of FIG. 1) of the web paper WP which is horizontal and perpendicular to a transport direction TD of the web paper WP. Consequently, printing can be done over a full width in the transverse direction WD of the web paper WP without moving the inkjet heads 23, i.e. while keeping them fixed in position, in the transverse direction WD of the web paper WP.

The printing unit 15 has a plurality of inkjet heads 23 arranged along the transport direction TD of the web paper WP. For example, four inkjet heads 23 are provided individually for black (K), cyan (C), magenta (M), and yellow (Y) in order from upstream.

The drying station 17 dries ink droplets adhering to the web paper WP printed by the inkjet heads 23. The drying station 17 has a heat drum 25 driven to rotate, and a warm air intake/exhaust unit 27. Details of the drying station 17 will be described hereinafter. The inspection unit 19 inspects whether there are scumming, omissions and so on in printed portions. The web paper WP after inspection is wound up in roll form on the takeup roller 7.

The above drying station 17 corresponds to the "drying apparatus" in this invention, and the heat drum 25 corresponds to the "drive roller".

The ink jet printing system 1 has a main controller 29 and a console unit 31. The main controller 29 performs overall control of the components of the ink jet printing system 1, and includes a CPU, memory, and so on. The console unit 31 operates the ink jet printing system 1, and includes a touch panel, various switches, and so on. The operator operates the console unit 31 and instructs printing conditions, drying conditions, etc. for the web paper WP.

Figure 2:
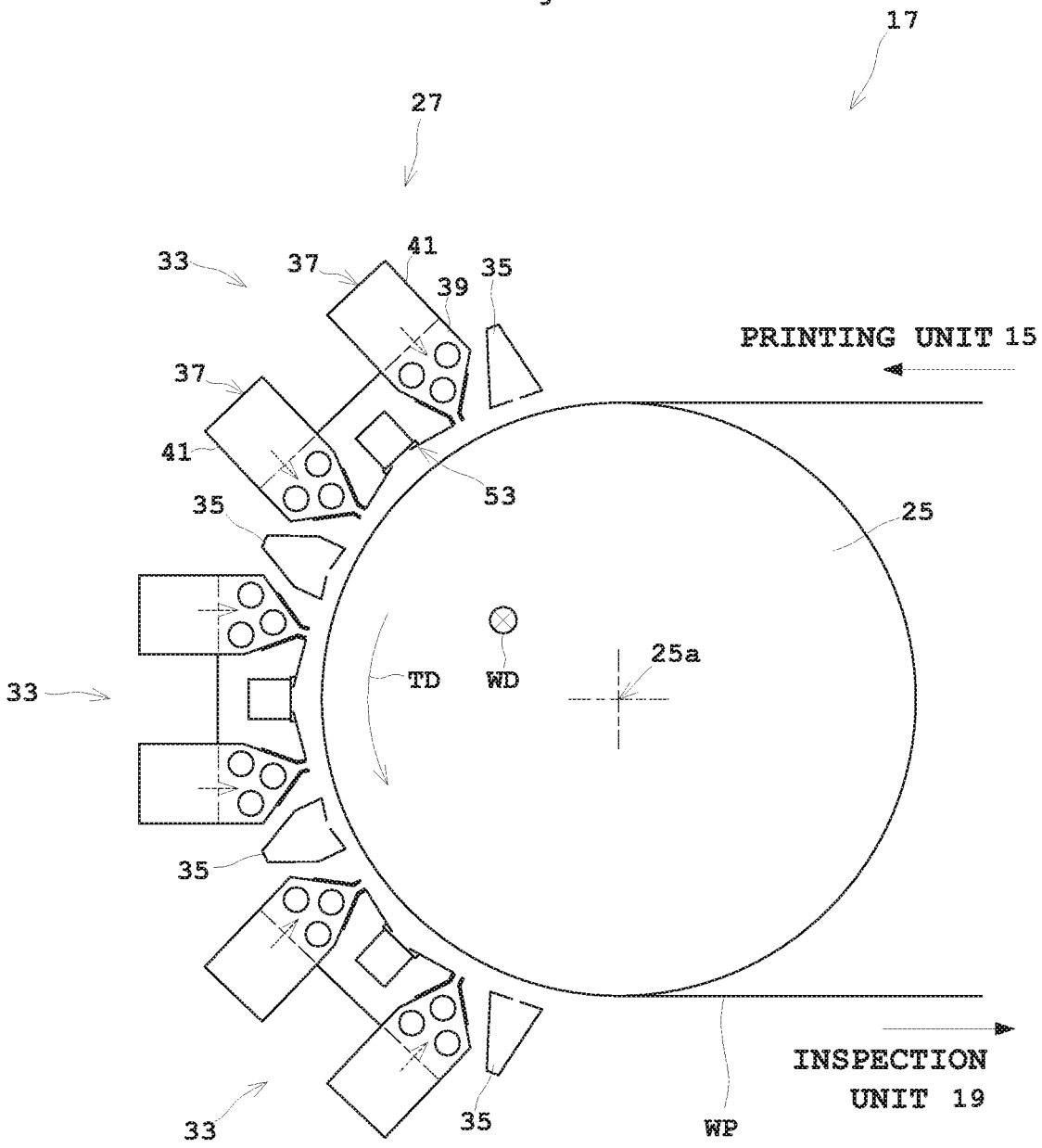
FIG. 2 is a side view showing a construction of a drying station.
Figure 3B:
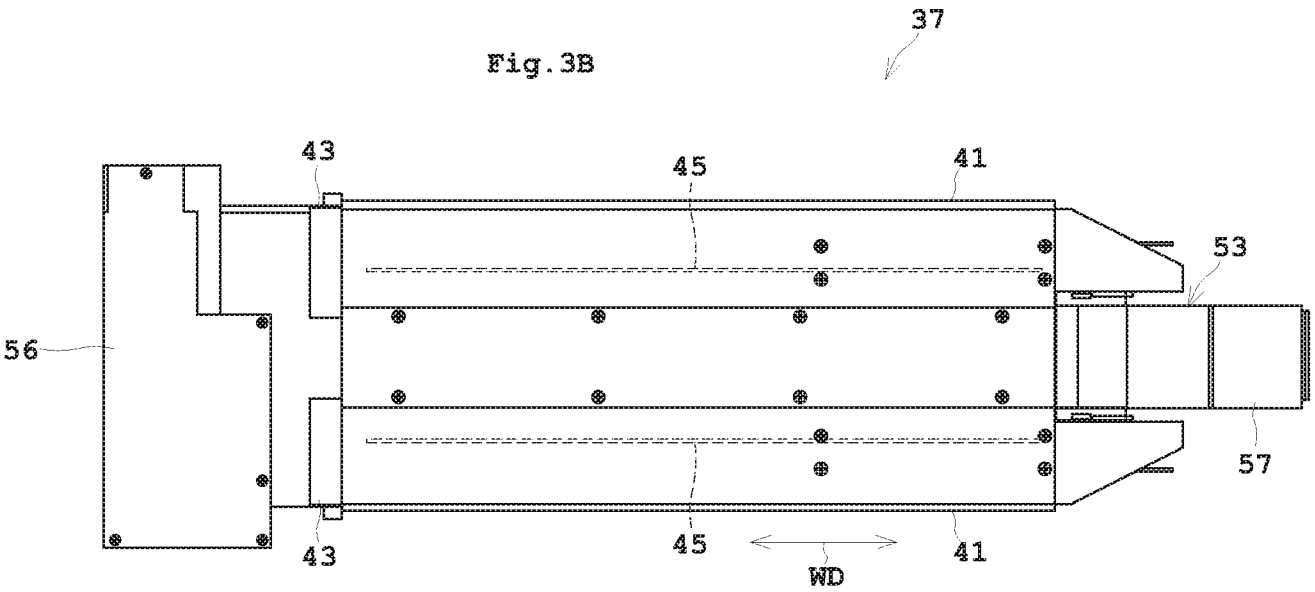
Figure 3A:
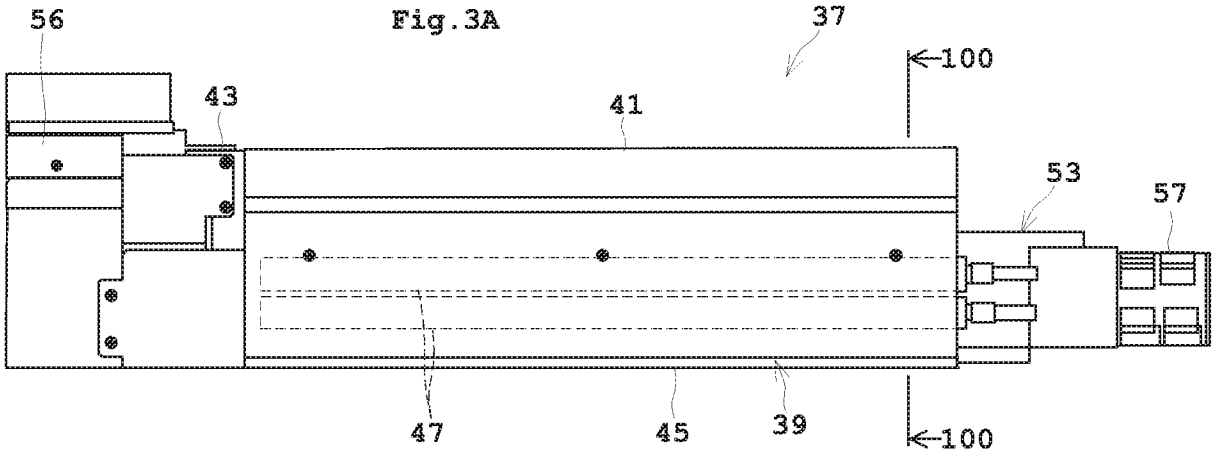
Figure 3C:
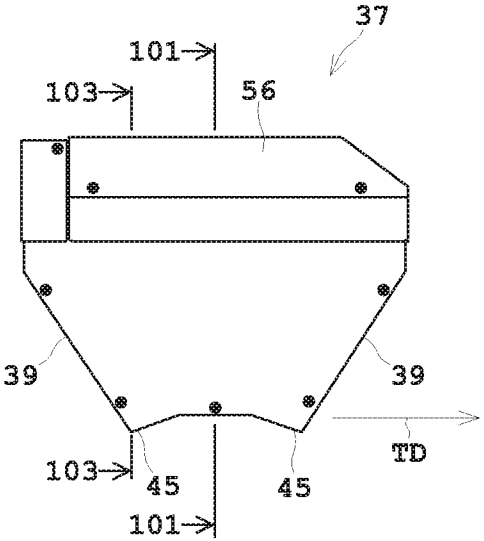
FIG. 3C is a left side view.
Figure 4:
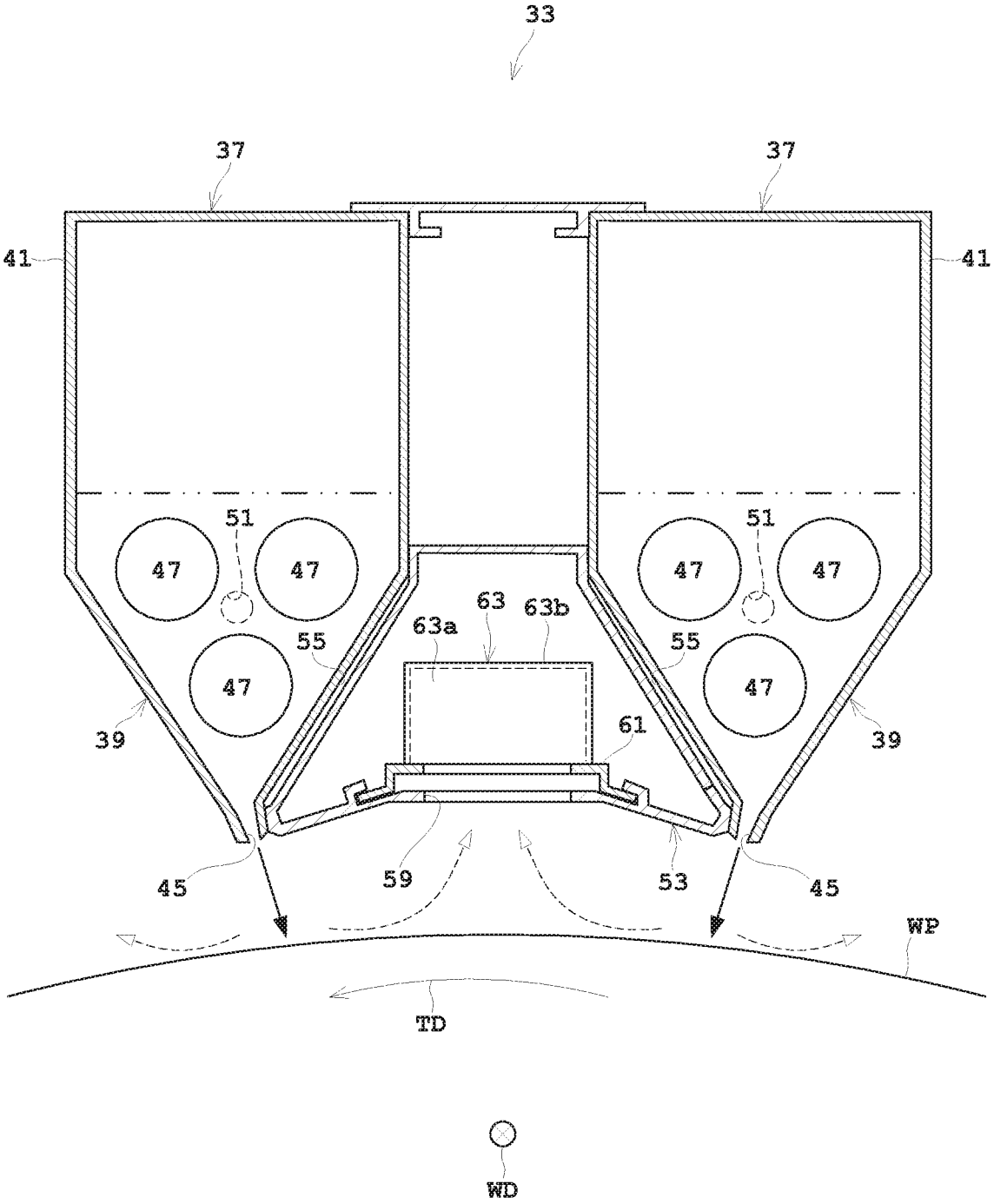
FIG. 4 is a section taken on line 100-100 of FIG. 3A.
Figure 5:
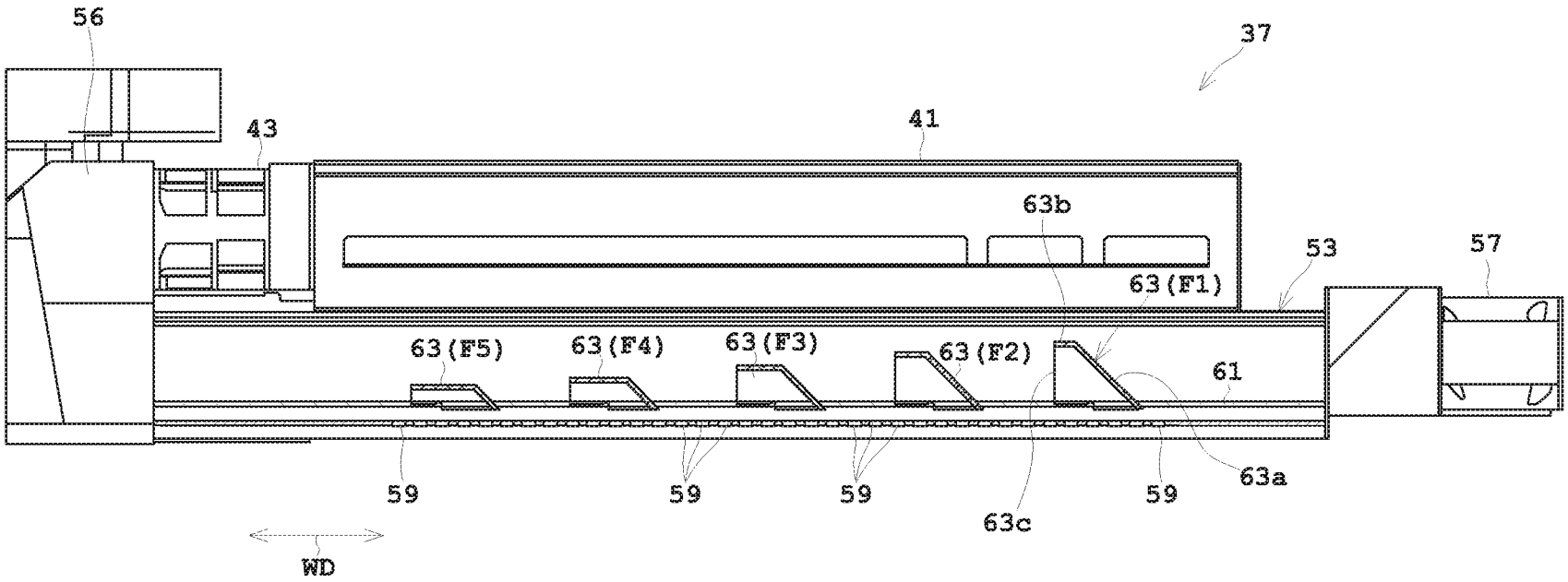
FIG. 5 is a section taken on line 101-101 of FIG. 3C.
Figure 6:
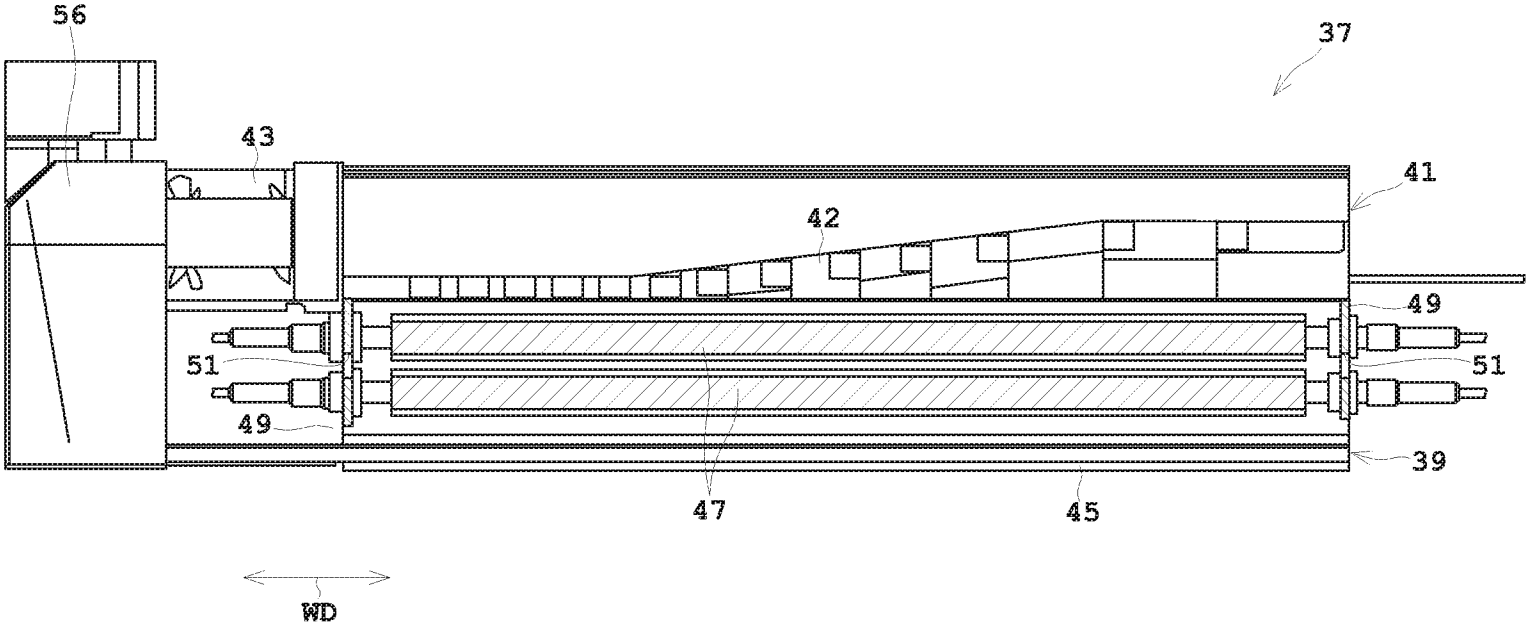
FIG. 6 is a section taken on line 103-103 of FIG. 3C.
Figure 7:
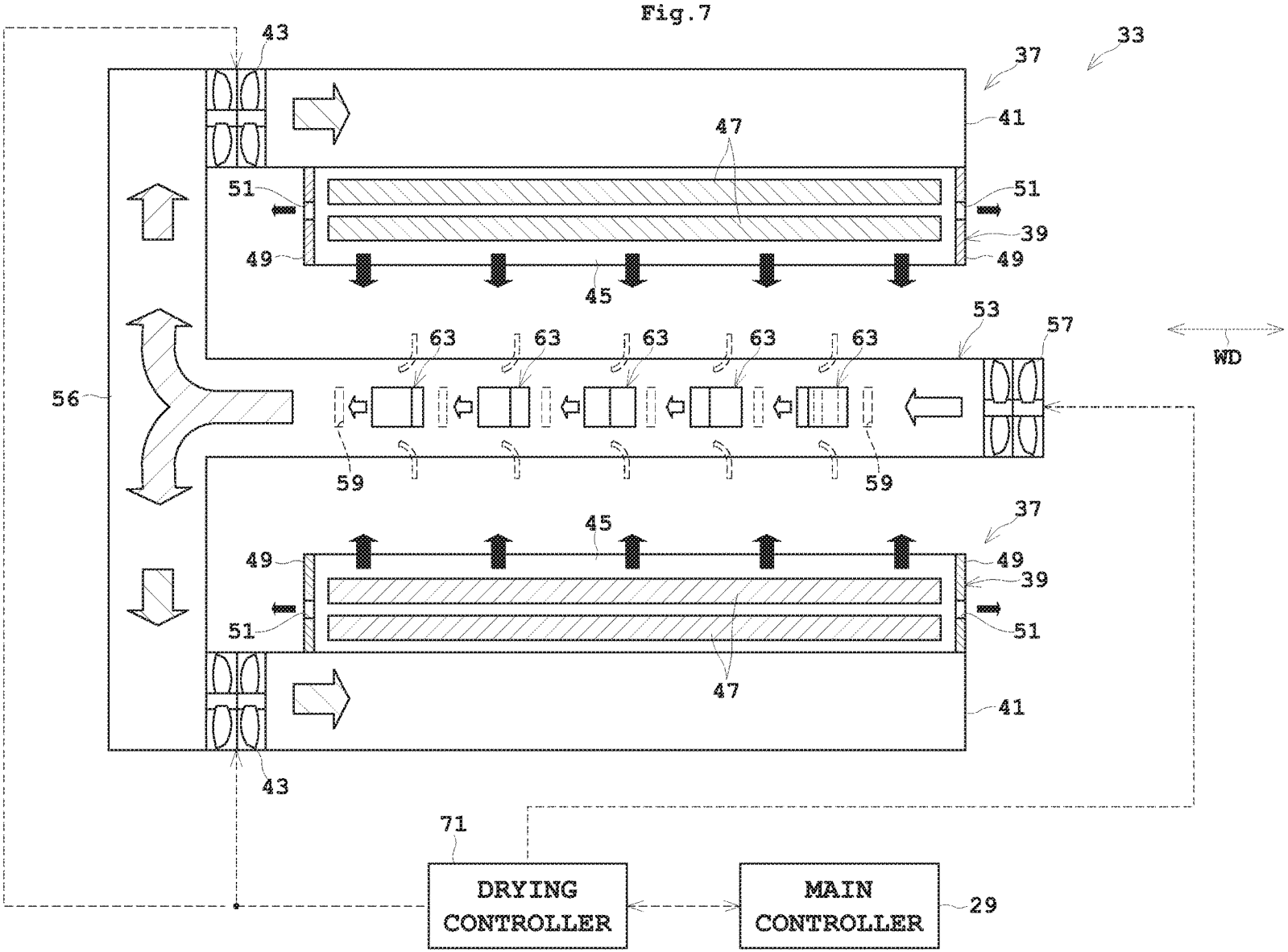
FIG. 7 is a conceptual diagram and block diagram of the warm air blasting unit schematically showing flows of warm air.

Details of the drying station 17 will now be described with reference to FIGS. 2-7. FIG. 2 is a side view showing a construction of the drying station. FIGS. 3A-3C are orthogonal views showing outward appearances of a warm air blasting unit, in which FIG. 3A is a front view, FIG. 3B is a plan view, and FIG. 3C is a left side view. FIG. 4 is a section taken on line 100-100 of FIG. 3A. FIG. 5 is a section taken on line 101-101 of FIG. 3C. FIG. 6 is a section taken on line 103-103 of FIG. 3C. FIG. 7 is a conceptual diagram and block diagram of the warm air blasting unit schematically showing flows of warm air.

The heat drum 25 is rotatable about a horizontal axis 25*a*. The heat drum 25 has a heating device mounted therein, such as a halogen heater or ceramic heater, for example. The heat drum 25 is heated to a predetermined temperature appropriate to drying conditions set beforehand. The heat drum 25 is formed of metal such as stainless steel plate. The heat drum 25 heats the web paper WP by rotating in contact with the opposite surface of the printed surface, to which ink droplets have been dispensed, of the web paper WP, while transporting the web paper WP along the transport route on the outer circumferential surface of the heat drum 25.

The warm air intake/exhaust unit 27 is located opposite the heat drum 25 across the transport route. That is, the warm air intake/exhaust unit 27 is arranged circumferentially of the heat drum 25. The warm air intake/exhaust unit 27 blows warm air toward the full width of the web paper WP on the transport route, collects part of the blown warm air, and discharges the remainder from the drying station 17. The warm air intake/exhaust unit 27 in this embodiment is arranged along a left semicircle, which is a downstream portion, of the heat drum 25. The warm air intake/exhaust unit 27 has warm air blasting units 33 and warm air exhaust units 35.

In this embodiment, for example, the warm air intake/exhaust unit 27 has three warm air blasting units 33, and four warm air exhaust units 35 located in positions adjacent the three warm air blasting units 33. Of the warm air blown from the warm air blasting units 33 toward the transport route, the warm air exhaust units 35 discharge to the exterior of the drying station 17 the remaining warm air not collected by the warm air blasting units 33.

Each warm air blasting unit 33 has a pair of warm air blasting portions 37. Each warm air blasting portion 37 has a nozzle case 39, a fan duct 41, and a blasting fan 43. The warm air blasting portion 37, preferably, is formed of aluminum. Since aluminum has higher thermal conductivity than iron, it has an advantage in uniforming a temperature distribution of warm air in the transverse direction WD.

The nozzle case 39 has a blasting port 45 formed therein for heating air and blowing off warm air toward the transport route. The blasting port 45 has a width slightly larger than the full width of the web paper WP. The nozzle case 39 contains heaters 47 as a device for heating air. This embodiment employs three sheathed heaters as heaters 47, for example. As shown in FIG. 6, the three heaters 47 have opposite ends thereof attached to side plates 49 of the nozzle case 39, and long axes extending parallel to the transverse direction WD of the web paper WP. The side plates 49 have spill holes 51 formed therein. These spill holes 51 let out part of the warm air to be blown off from the nozzle case 39. The nozzle case 39, as shown in FIG. 4, has a vertical section assuming the shape of an inverted triangle when seen from the transverse direction WD perpendicular to the transport direction TD of the web paper WP.

The fan duct 41 is mounted in an upper part of the nozzle case 39. The fan duct 41 has a blasting fan 43 attached adjacent one end thereof. Air is fed into the fan duct 41 by the blasting fan 43. This blasting fan 43, in order to obtain a large quantity of airflow, preferably is a counter-rotating fan combining a plurality of fans in series, for example. As shown in FIG. 6, the fan duct 41 has a baffle member 42 mounted therein. The baffle member 42 narrows a passage sectional area to increase flow path resistance with distance in the transverse direction WD away from the blasting fan 43. Consequently, the air fed from the blasting fan 43 is supplied to the nozzle case 39 substantially uniformly throughout in the transverse direction WD. In this embodiment, for expediency of description, one end side will be called the near side, and the other end side the far side as appropriate.

One air intake duct 53 is located between each pair of warm air blasting portions 37 in the transport direction TD. The air intake duct 53, as shown in FIG. 4, has a vertical section assuming a triangular shape when seen from the transverse direction WD. Consequently, when the air intake duct 53 is combined with the nozzle cases 39, their length in the transport direction TD can be shortened to realize compactness of the warm air blasting unit 33.

As shown in FIG. 4, the air intake duct 53 is attached through air layers 55 to the nozzle cases 29 of the pair of warm air blasting portions 37. The air layers 55 are provided by gaps formed between outer lateral surfaces, not in close contact with each other, of the air intake duct 53 and nozzle cases 29. These air layers 55 are provided to serve as air heat insulation. The larger air layers 55 have the better heat insulation effect, but will be obstructive to reduction in size. So, in this embodiment, the thickness of air layers 55 is set to about 1 mm, for example.

The air intake duct 53 is connected by a branch pipe 56 to one end of each of the two fan ducts 41. The air intake duct 53 collects part of the warm air blown from the pair of warm air blasting portions 37 toward the transport route. This air intake duct 53 has a suction fan 57 attached to a side opposed to the position connected to the fan ducts 41. This suction fan 57 takes in ambient air and feeds it into the fan ducts 41. This suction fan 57 preferably is a counter-rotating fan, for example, as is the blasting fan 43 described above. Since the air intake duct 53 is shared by the pair of warm air blasting portions 37, the passage sectional area can be made larger than in the conventional example.

As shown in FIGS. 4 and 5, the air intake duct 53 has a plurality of air intake ports 59 formed in a surface opposed to the transport route and arranged along the transverse direction WD. A hood mounting plate 61 is provided above the air intake ports 59. A plurality of air intake hoods 63 are formed on the hood mounting plate 61. In this embodiment, five air intake hoods 63 are formed at predetermined intervals in the transverse direction W. The five air intake hoods 63 will be called air intake hoods F1-F5 in order from the suction fan 57 as necessary.

As shown in FIG. 5, the five air intake hoods 63 have back plates 63*a* opposed to the suction fan 57 and erected from the hood mounting plate 61 These back plates 33*a* have an angle of about 45° for all the air intake hoods 63, for example. Top plates 63*b* extend from upper parts of the back plates 63*a* away from the suction fan 57. Portions surrounded by these plates form openings 63*c* which open away from the suction fan 57. The five air intake hoods 63 have lengths in the transverse direction WD of the back plates 63*a* becoming progressively shorter away from the suction fan 57, and lengths in the transverse direction WD of the top plates 63*b* progressively longer away from the suction fan 57. Consequently, each air intake hood 63 is formed to have a different passage sectional area in the opening 63*c*.

Figure 8:
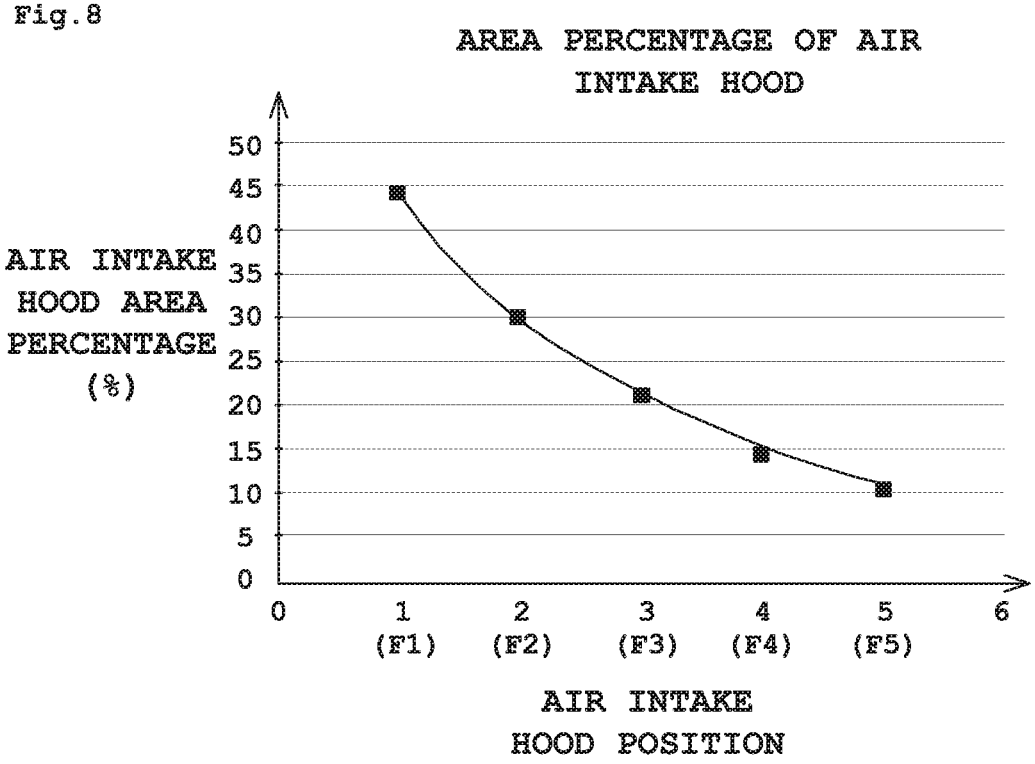
FIG. 8 is a graph showing a positional relationship between air intake hood area percentage and air intake hoods.

Specifically, based on the passage sectional area of the air intake duct 53 (see FIG. 4) as reference, the percentage of the opening 63*c* of each air intake hood 63 is assumed to be air intake hood area percentage (%). In this embodiment, the relationship between these and a position of each air intake hood 63 is set to be a logarithmic relationship. Specifically, it is a relationship as shown in FIG. 8. FIG. 8 is a graph showing a positional relationship between air intake hood area percentage and air intake hood. Specifically, an area of the opening 63*c* of each air intake hood 63 is set so that a relationship between air intake hood area percentage and the position of each air intake hood 63 may be on a curve expressed by a logarithmic function of $-20.73 \ln(x)+44.052$.

Figure 9:
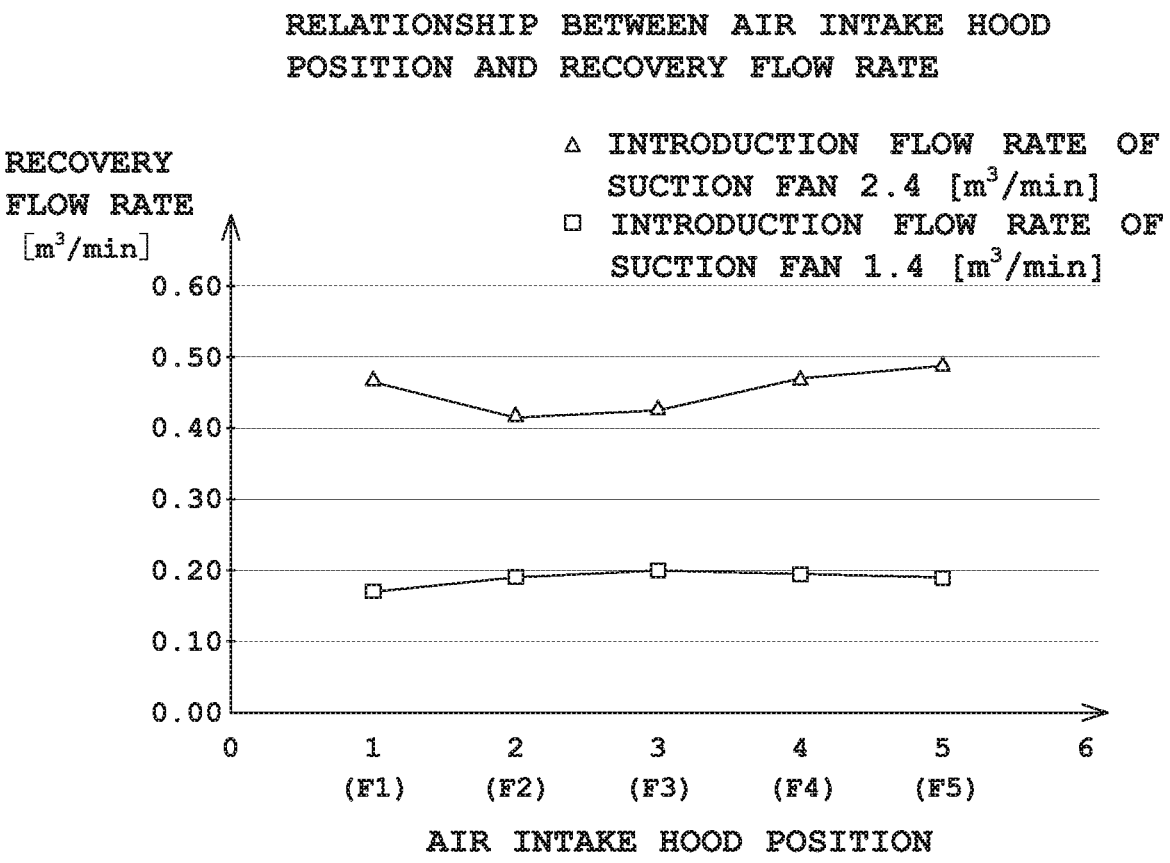
FIG. 9 is a graph showing a relationship between air intake hood position and distribution of recovery flow rate.
Figure 10:
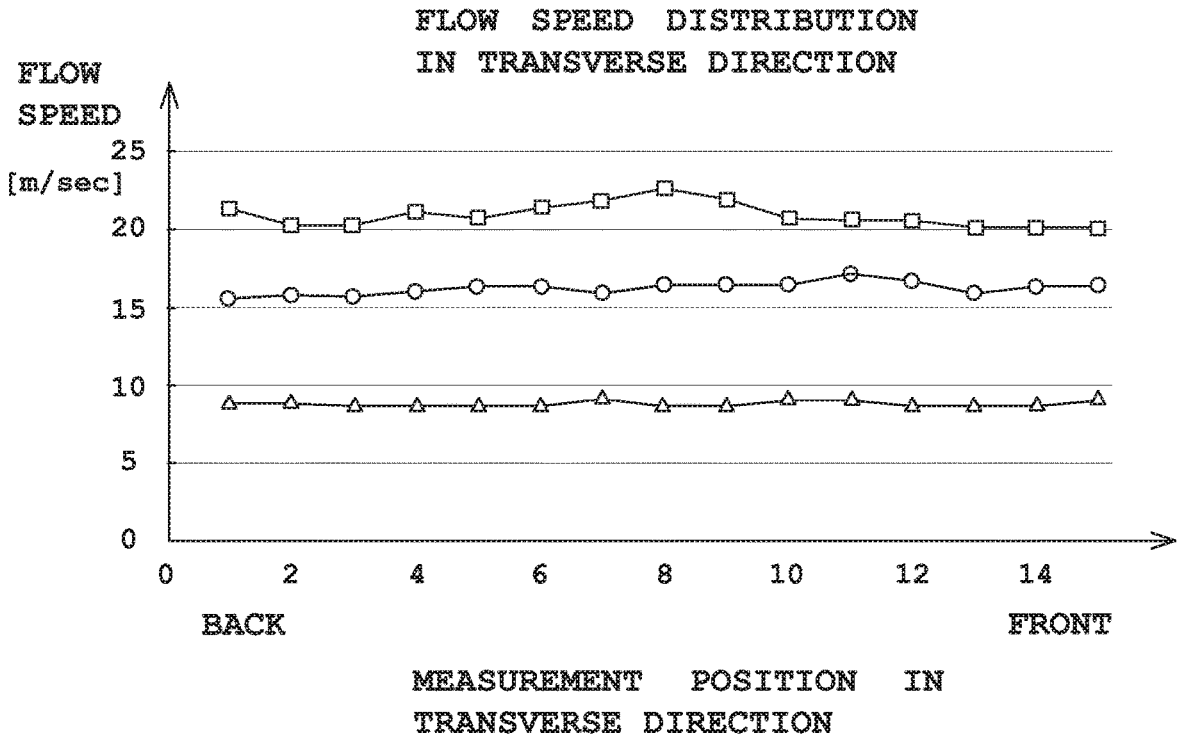
FIG. 10 is a graph showing a flow speed distribution in a trans-verse direction.

Since each air intake duct 53 is formed as described above, the following effects are acquired. Reference is made here to FIGS. 9 and 10. FIG. 9 is a graph showing a relationship between air intake hood position and distribution of recovery flow rate. FIG. 10 is a graph showing a flow speed distribution in the transverse direction.

The graph of FIG. 9 shows flow rates (recovery flow rates) of the air intake hoods 63 (F1-F5) at times of changing the introduction flow rate (quantity of airflow) by the suction fan 57 to 2.4 [$m^3$/min] and 1.4 [$m^3$/min]. As seen, even when the introduction quantity of airflow by the suction fan 57 is changed, the recovery flow rates of the air intake hoods 63 (F1-F5) arranged in the transverse direction WD remain nearly uniform, with only part of the recovery flow rates allowed to change considerably. The necessity of changing such introduction flow rate of the suction fan 57 depends on drying conditions of the web paper WP.

For example, with web paper WP of the first class (e.g. coated paper) into which the ink droplets cannot sink easily, and web paper WP of the second class (e.g. transaction paper) into which the ink droplets sink easily, their states after printing are different, and therefore naturally the drying conditions are different. For the web paper WP of the first class, for example, suitable drying conditions are a small quantity of airflow at a high temperature, and for the web paper WP of the second class, suitable drying conditions are a large quantity of airflow at a low temperature. Thus, it is preferable to change the quantity of airflow according to the drying conditions. According to this embodiment, even when the suction fan 57 is controlled to change the quantity of airflow, the recovery quantity of airflow can be maintained uniform depending on the positions in the transverse direction WD. Consequently, even when the quantity of airflow is changed according to the drying conditions, the dry degree of the web paper WP in the transverse direction WD can be uniformed.

Since the recovery flow rates are uniformed in the transverse direction WD, as shown in FIG. 10, the flow speed in each position of the blasting port 45 in the transverse direction WD can also be uniformed. That is, even when the quantity of airflow of the suction fan 57 is changed to change the flow speed of the warm air blown from the blasting port 45, the flow speed in each position on the transport route in the transverse direction WD can be maintained nearly uniform.

The warm air blasting unit 33 constructed as described above, as shown in FIG. 7, has the suction fan 57 and blasting fans 43 operated, and the quantity of airflow of each controlled, by a drying controller 71. The drying controller 71 is controlled by the main controller 29. The drying controller 71 controls the quantity of airflow of the suction fan 57 to be less than a sum of the quantities of airflow of the two blasting fans 43. Consequently, the difference between of the total of the quantities (flow rates) of airflow of the two blasting fans 43 and the quantity of airflow of the suction fan 57 is compensated by the warm air collected from the air intake ports 59. These air intake ports 59 collect from the blasting ports 45 part of the warm air supplied to the web paper WP on the transport route. The warm air collected by these air intake ports 59 includes the moisture of the ink droplets. Consequently, unless the collection of warm air from these air intake ports 59 is uniform in the transverse direction WD, the dryness in the transverse direction WD of the web paper WP on the transport route does not become uniform.

The quantity of airflow from the blasting ports 45 is nearly uniform at opposite ends in the transverse direction WD as shown in FIG. 10. This is the effect produced by the spill holes 51 formed in the side plates 49 located at opposite ends of each blasting port 45.

Figure 11A:
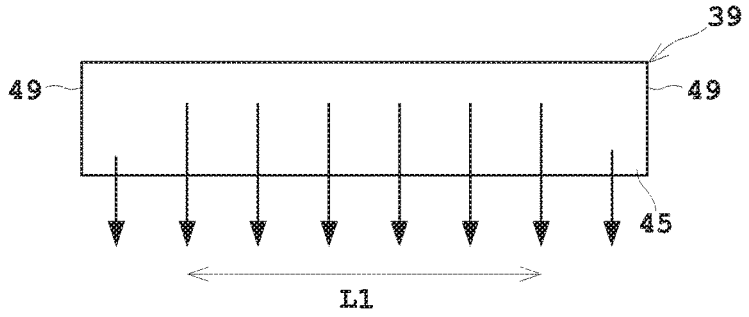
Figure 11B:
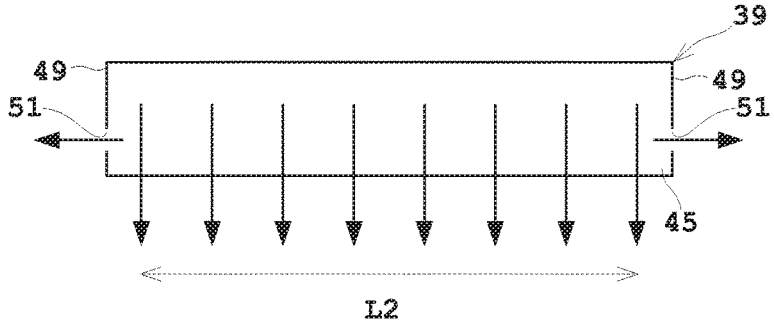

Reference is now made to FIGS. 11A and 11B. FIGS. 11A and 11B are schematic views illustrating the effect of the spill holes, in which FIG. 11A shows a conventional technique, and FIG. 11B shows the embodiment.

As shown in FIG. 11A, a flow speed uniform length L1 is a length of uniform flow speed in the transverse direction WD of the warm air blown from the blasting port 45. With this conventional technique, since the flow speed lowers due to friction with the side plates 49 adjacent the opposite ends relative to the opening length of the blasting port 45 in the transverse direction WD, the flow speed uniform length L1 becomes considerably shorter than the opening length. In this embodiment, however, since part of the warm air is discharged from the spill hole 51 in each side plate 49 as shown in FIGS. 4, 6, 7 and 11B, the friction causing pressure loss in the opposite end regions of the blasting port 45 can be reduced. Consequently, a flow speed uniform length L2 becomes longer than the flow speed uniform length L1, to enable blasting of the warm air having a nearly uniform flow speed over the full width of the blasting port 45. As a result, the nozzle case 39 can be reduced in size in the transverse direction WD, thereby to attain a reduction in size of the warm air blasting unit 33.

Unlike the conventional example, as described above, this embodiment provides one air intake duct 53 disposed between a pair of warm air blasting portions 37, and connected to one end of each of the fan ducts 41 of the warm air blasting portions 37. Consequently, since the one air intake duct 53 recovers warm air, the passage sectional area can be made larger than in the prior art. As a result, the intake of warm air in the transverse direction WD of the web paper WP can be made substantially uniform compared with that in the prior art. This can substantially uniform a temperature distribution on the transport route to which the warm air is blown from the blasting ports 45 of the nozzle cases 39. Consequently, the degree of dryness in the transverse direction WD of the web paper WP can be made substantially uniform. Further, the ink jet printing system 1 having such warm air blasting unit 33 can make the degree of dryness in the transverse direction WD of the web paper WP substantially uniform, which can expect an improved print quality by the printing unit 15.

Figure 12:
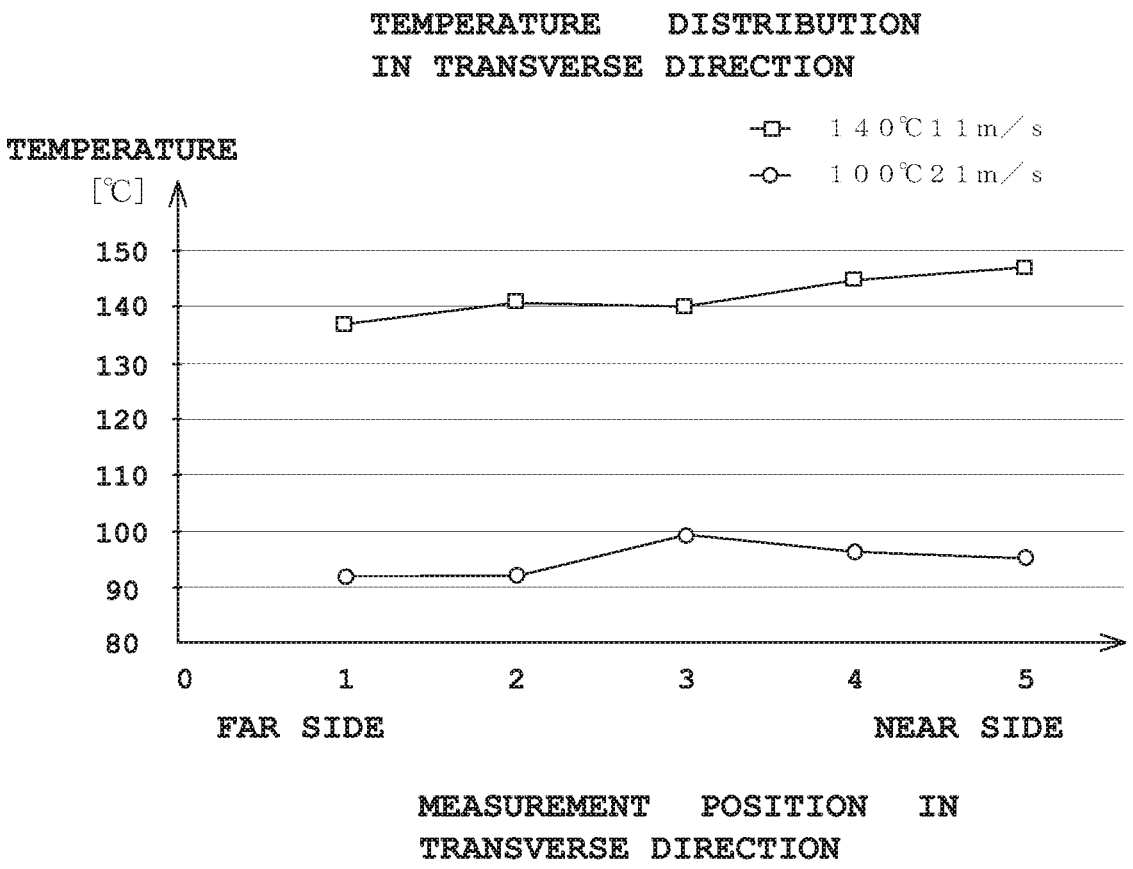
FIG. 12 is a graph showing a temperature distribution in the transverse direction.

Reference is now made to FIG. 12. FIG. 12 is a graph showing a temperature distribution in the transverse direction.

This graph of FIG. 12 shows results of measuring temperatures on the transport route in the transverse direction WD when the web paper WP is dried by blowing warm air with two types of drying conditions, i.e. first drying conditions (temperature of warm air: 100° C. and flow speed: 21 m/s) and second drying conditions (temperature of warm air: 140° C., flow speed: 11 m/s). It is seen from these results that there is no large temperature gradient in the transverse direction WD with either one of the two different drying conditions, and that nearly uniform temperature distributions are obtained.

In this embodiment, air heat insulation is provided for each nozzle case 39 and air intake duct 53 by locating the air layer 55 between nozzle case 39 and air intake duct 53. Consequently, the nozzle cases 39 are not subject to influences of air colder than the warm air in the nozzle cases 39, the cold air being fed in by the suction fan 57 from the other end of the air intake duct 53, thereby preventing a temperature drop in portions adjacent the suction fan 57 of the nozzle cases 39. As a result, the temperature distribution in the transverse direction WD of the web paper WP of the warm air blown off from the blasting ports 45 of the nozzle cases 39 can be made further uniform.

This invention is not limited to the foregoing embodiment, but may be modified as follows:

(1) In the foregoing embodiment, the drying station 17 has three warm air blasting units 33, but this invention is not limited to such configuration. That is, the drying station 17 may have at least one warm air blasting unit 33, or may have four or more such units 33.

(2) In the foregoing embodiment, the air layers 55 are located between the nozzle cases 39 and air intake duct 53. However, this invention does not regard this construction as indispensable.

(3) In the foregoing embodiment, each air intake duct 53 has five air intake hoods 63 (F1-F5), but this invention is not limited to this number. The air intake duct 53 may have six or more air intake hoods 63. Further, the relationship between opening area percentage and arrangement position of the air intake hoods 63 (F1-F5) is located on a curve of a logarithmic function. However, this invention does not regard this as indispensable.

(4) In the foregoing embodiment, the nozzle cases 39 assume a shape of an inverse triangle and the air intake duct 53 a triangular shape. However, this invention is not limited to such shapes.

(5) In the foregoing embodiment, the spill holes 51 are formed in the side plates 49 of each nozzle case 39. This invention does not regard these spill holes 51 indispensable.

(6) The foregoing embodiment has been described taking the web paper WP as an example of printing media. However, this invention is not limited to such a printing medium. As another printing medium, film may be mentioned, for example.

This invention may be embodied in other specific forms without departing from the spirit or essential attributes thereof and, accordingly, reference should be made to the appended claims, rather than to the foregoing specification, as indicating the scope of the invention.

What is claimed is:

1. A drying apparatus for drying a printing medium having ink droplets dispensed thereto, comprising:

a drive roller rotatable in contact with an opposite surface of a printed surface, to which the ink droplets have been dispensed, of the printing medium, while transporting the printing medium along a transport route; and a warm air blasting unit located opposite the drive roller across the transport route for blowing warm air toward a full width of the printing medium on the transport route;

wherein the warm air blasting unit includes:

a pair of warm air blasting portions, each having a nozzle case for heating air, the nozzle case forming a blasting port for blowing off warm air toward the transport route, a fan duct attached to the nozzle case for feeding air into the nozzle case, and a blasting fan attached to one end of the fan duct;

one air intake duct located between the pair of warm air blasting portions in a transport direction of the printing medium and connected to one end of each of the fan ducts of the pair of warm air blasting portions for collecting part of the warm air blown off from the blasting ports of the pair of warm air blasting portions; and a suction fan disposed at the other end of the one air intake duct which corresponds to the other ends of the fan ducts for feeding ambient air into the one air intake duct, wherein the one air intake duct has:

warm air intake ports arranged adjacent the transport route from adjacent the suction fan to adjacent the blasting port; and a plurality of air intake hoods arranged linearly along the warm air intake ports, with openings that open away from the suction fan, and wherein the openings of the air intake hoods are formed such that, when a ratio of a sectional area of each opening to a passage sectional area of the one air intake duct is a hood area percentage, the hood area percentage becomes smaller away from the suction fan.

2. The drying apparatus according to claim 1, wherein each nozzle case and the air intake duct have an air layer located in between.

3. The drying apparatus according to claim 2, wherein the blasting ports of the warm air blasting unit are in positions directed downward to provide such vertical sectional shapes seen from a transverse direction perpendicular to the transport direction of the printing medium as an inverted triangular shape for the nozzle cases and a triangular shape for the one air intake duct.

4. The drying apparatus according to claim 3, wherein each nozzle case has side plates arranged at opposite ends of the blasting port in a transverse direction perpendicular to the transport direction of the printing medium, the side plates having spill holes for letting out part of the warm air to be blown off from the nozzle case.

5. The drying apparatus according to claim 2, wherein the blasting ports of the warm air blasting unit are in positions directed downward to provide such vertical sectional shapes seen from a transverse direction perpendicular to the transport direction of the printing medium as an inverted triangular shape for the nozzle cases and a triangular shape for the one air intake duct.

6. The drying apparatus according to claim 2, wherein each nozzle case has side plates arranged at opposite ends of the blasting port in a transverse direction perpendicular to the transport direction of the printing medium, the side plates having spill holes for letting out part of the warm air to be blown off from the nozzle case.

7. The drying apparatus according to claim 2, wherein each nozzle case has side plates arranged at opposite ends of the blasting port in a transverse direction perpendicular to the transport direction of the printing medium, the side plates having spill holes for letting out part of the warm air to be blown off from the nozzle case.

8. The drying apparatus according to claim 1, wherein the blasting ports of the warm air blasting unit are in positions directed downward to provide such vertical sectional shapes seen from a transverse direction perpendicular to the transport direction of the printing medium as an inverted triangular shape for the nozzle cases and a triangular shape for the one air intake duct.

9. The drying apparatus according to claim 8, wherein each nozzle case has side plates arranged at opposite ends of the blasting port in a transverse direction perpendicular to the transport direction of the printing medium, the side plates having spill holes for letting out part of the warm air to be blown off from the nozzle case.

10. The drying apparatus according to claim 1, wherein the blasting ports of the warm air blasting unit are in positions directed downward to provide such vertical sectional shapes seen from a transverse direction perpendicular to the transport direction of the printing medium as an inverted triangular shape for the nozzle cases and a triangular shape for the one air intake duct.

11. The drying apparatus according to claim 1, wherein each nozzle case has side plates arranged at opposite ends of the blasting port in a transverse direction perpendicular to the transport direction of the printing medium, the side plates having spill holes for letting out part of the warm air to be blown off from the nozzle case.

12. The drying apparatus according to claim 1, wherein each nozzle case has side plates arranged at opposite ends of the blasting port in a transverse direction perpendicular to the transport direction of the printing medium, the side plates having spill holes for letting out part of the warm air to be blown off from the nozzle case.

13. The drying apparatus according to claim 1, wherein the hood area percentage becomes smaller away from the suction fan along a logarithmic function.

14. A printing apparatus for printing on a printing medium, comprising:

a printing unit for performing printing by dispensing ink droplets to the printing medium; and a drying device disposed downstream of the printing unit;

wherein the drying device includes:

a drive roller rotatable in contact with an opposite surface of a printed surface, to which the ink droplets have been dispensed, of the printing medium, while transporting the printing medium along a transport route; and a warm air blasting unit located opposite the drive roller across the transport route for blowing warm air toward a full width of the printing medium on the transport route;

wherein the warm air blasting unit includes:

a pair of warm air blasting portions, each having a nozzle case for heating air, the nozzle case forming a blasting port for blowing off warm air toward the transport route, a fan duct attached to the nozzle case for feeding air into the nozzle case, and a blasting fan attached to one end of the fan duct;

one air intake duct located between the pair of warm air blasting portions in a transport direction of the printing medium and connected to one end of each of the fan ducts of the pair of warm air blasting portions for collecting part of the warm air blown off from the blasting ports of the pair of warm air blasting portions; and a suction fan disposed at the other end of the one air intake duct which corresponds to the other ends of the fan ducts for feeding ambient air into the one air intake duct, wherein the one air intake duct has:

warm air intake ports arranged adjacent the transport route from adjacent the suction fan to adjacent the blasting port; and a plurality of air intake hoods arranged linearly along the warm air intake ports, with openings that open away from the suction fan, and wherein the openings of the air intake hoods are formed such that, when a ratio of a sectional area of each opening to a passage sectional area of the one air intake duct is a hood area percentage, the hood area percentage becomes smaller away from the suction fan.

15. The printing apparatus according to claim 14, wherein the hood area percentage becomes smaller away from the suction fan along a logarithmic function.

16. A drying apparatus for drying a printing medium having ink droplets dispensed thereto, comprising:

a drive roller rotatable in contact with an opposite surface of a printed surface, to which the ink droplets have been dispensed, of the printing medium, while transporting the printing medium along a transport route; and a warm air blasting unit located opposite the drive roller across the transport route for blowing warm air toward a full width of the printing medium on the transport route;

wherein the warm air blasting unit includes:

a pair of warm air blasting portions, each having a nozzle case for heating air, the nozzle case forming a blasting port for blowing off warm air toward the transport route, a fan duct attached to the nozzle case for feeding air into the nozzle case, and a blasting fan attached to one end of the fan duct;

one air intake duct located between the pair of warm air blasting portions in a transport direction of the printing medium and connected to one end of each of the fan ducts of the pair of warm air blasting portions for collecting part of the warm air blown off from the blasting ports of the pair of warm air blasting portions; and a suction fan disposed at the other end of the one air intake duct which corresponds to the other ends of the fan ducts for feeding ambient air into the one air intake duct, and wherein each nozzle case has side plates arranged at opposite ends of the blasting port in a trans-verse direction perpendicular to the transport direction of the printing medium, the side plates having spill holes for letting out part of the warm air to be blown off from the nozzle case.

* * * * *